United States Patent [19]

Takach, Jr.

[11] Patent Number: 4,542,372

[45] Date of Patent: Sep. 17, 1985

[54] DATA DISTRIBUTION APPARATUS

[75] Inventor: Eugene J. Takach, Jr., Lake Zurich, Ill.

[73] Assignee: Honeywell Inc., Minneapolis, Minn.

[21] Appl. No.: 508,634

[22] Filed: Jun. 28, 1983

[51] Int. Cl.[4] ..... G08B 23/00; H01R 13/50

[52] U.S. Cl. ..... 340/500; 340/514; 340/518; 340/651; 340/653; 340/656; 339/193 P; 361/332; 361/344; 361/351; 200/50 A; 200/50 C; 174/66

[58] Field of Search ..... 340/500, 506, 508, 514, 340/518, 525, 533, 534, 653, 651, 656; 339/193 P, 198 J; 174/66, 67; 361/331, 332, 333, 334, 335, 344, 350, 351, 347; 200/50 A, 50 B, 50 C, 43, 45, 51.03

[56] References Cited

U.S. PATENT DOCUMENTS

| | | | |
|---|---|---|---|
| 3,718,889 | 2/1973 | Bartlett | 339/198 J |
| 3,746,933 | 7/1973 | Knitter et al. | 339/198 J |
| 3,808,585 | 4/1974 | Izumida et al. | 339/198 J |
| 3,846,739 | 11/1974 | Devlin et al. | 339/198 J |
| 4,284,316 | 8/1981 | Debaigt | 339/198 J |
| 4,464,006 | 8/1984 | Witt | 339/198 J |

*Primary Examiner*—Donnie L. Crosland

*Attorney, Agent, or Firm*—Mitchell J. Halista; Trevor B. Joike

[57] ABSTRACT

A data distribution apparatus for controlling the distribution of data signals from field mounted devices to a central processor includes a backplate having wiring connected thereto between the backplate and the field mounted devices and between the backplate and the data processor. A cover for the backplate includes a printed circuit board mounted thereon with an electrical connector extending therefrom. The cover connector is arranged to mate with an electrical connector board mounted on the backplate to selectively connect the printed circuit board on the cover to electrical circuits connected to the connector board on the backplate. Thus, the removal of the cover which is keyed to the backplate to ensure a correct orientation thereof on the backplate is effective to interrupt the electrical connections provided by the printed circuit board among the wiring connected to the electrical connector board and vice versa.

10 Claims, 2 Drawing Figures

DATA DISTRIBUTION APPARATUS

BACKGROUND OF THE INVENTION

Field of the Invention

The present invention relates to data handling systems. More specifically, the present invention is directed to a data distribution apparatus for controlling the communication of data signals in a data handling system.

SUMMARY OF THE INVENTION

An object of the present invention is to provide an improved data distribution apparatus for a data handling system.

In accomplishing this and other objects, there has been provided, in accordance with the present invention a data distribution apparatus for controlling the communication of data signals in a data handling system and having a connector means for providing a first plurality of electrical connectors for supplying electrical signals and a second plurality for receiving electrical signals and cover means for said connector means for electrically joining said first and second plurality of said electrical connectors in a predetermined pattern when said cover means is mounted on said connector means. The apparatus may further include electrical conductor means connected to said first and second plurality of said electrical connectors for providing a plurality of electrical conductors terminating at one end thereof in corresponding ones of said electrical connectors, data signal supply means connected to predetermined ones of said electrical connectors and data signal receiving means connected to other ones of said electrical conductors.

BRIEF DESCRIPTION OF THE DRAWING

A better understanding of the present invention may be had when the following detailed description is read in connection with the accompanying drawings, in which.

DESCRIPTION OF THE PREFERRED EMBODIMENT

Detailed Description

Figure 1:
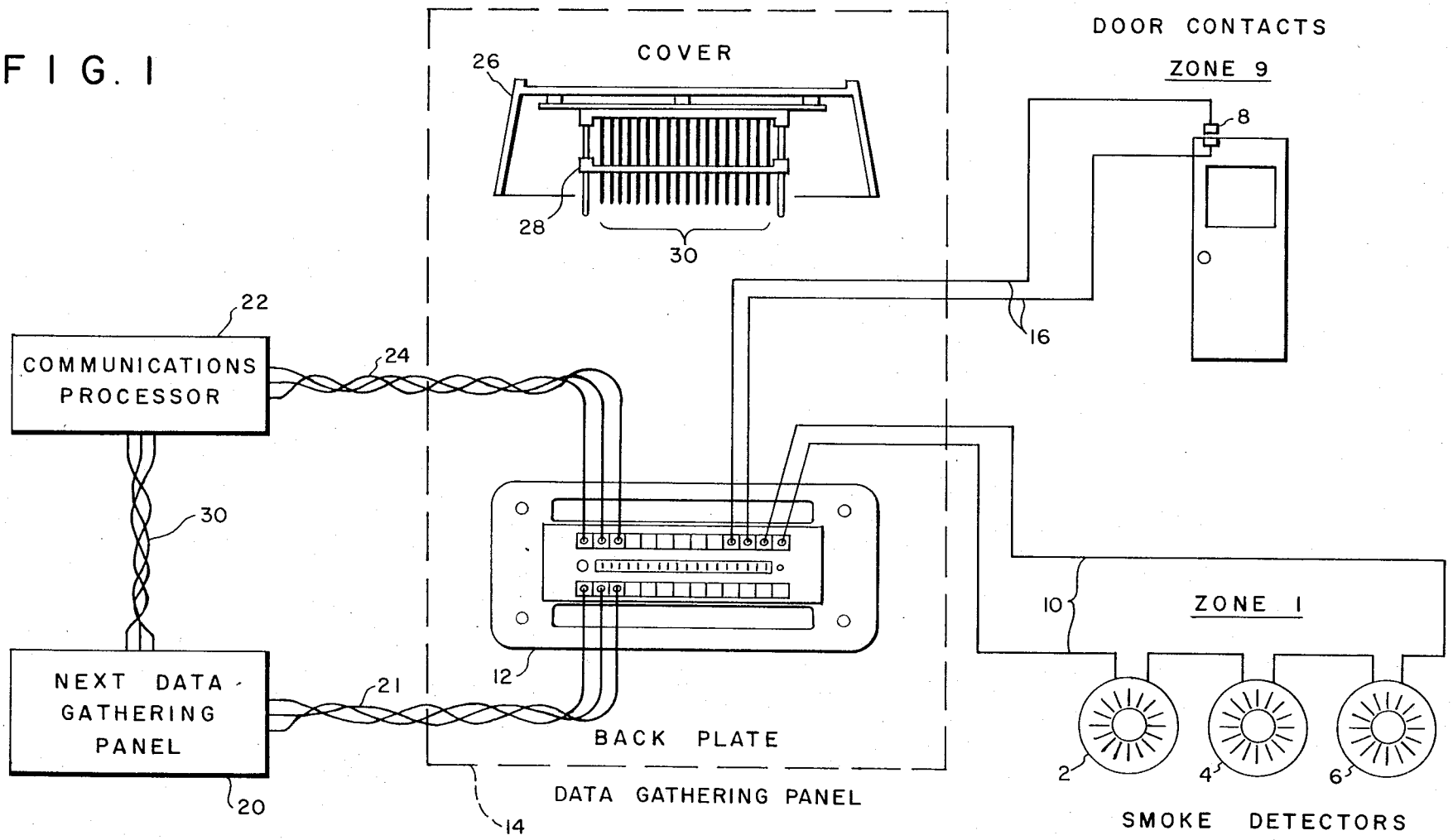
FIG. 1 is a block diagram of a data handling system using an example of a data distribution apparatus embodying the present invention and FIG. 2 is a pictorial illustration of an example of the data distribution apparatus shown in FIG. 1.

Referring to FIG. 1 in more detail, there is shown a block diagram illustration of a data handling system utilizing a data distribution apparatus embodying an example of the present invention for providing communication links between remote data supplying elements and a central data processor. The data supplying elements located in a remote area identified as zone 1 are illustrated as smoke detectors, 2, 4 and 6. A second data supply element is shown as door contacts 8 located in an area identified as zone 9. Accordingly, the operation of the smoke detectors, 2, 4, and 6 and the operation of the door monitored by the door contacts 8 are effective to produce signals for communication to the data handling system. The data distribution apparatus of the present invention is effective to provide a selectively operation data communication link for controlling the transmission of those signals. Specifically the smoke detectors 2, 4 and 6 are connected via connecting wires 10 to respective contacts on a backplate connector 12 mounted on a first 8 data gathering panel 14. Similarly, the door contacts are connected via connecting wires 16 to respective contacts on the backplate connector 12. Other contacts on the backplate connector are connected to a second or next data gathering panel 20 via a cable 21 and still other contacts are connected to a communications processor 22 by cable 24.

A cover 26 for the backplate is arranged to support a printed circuit board 28 which has contacts 30 attached to thereto. The contacts 30 are arranged to mate with the connector on the backplate connector 12 when the cover 26 is mounted on the backplate connected 12 and fastened thereto. The printed circuit board 28 can also provide associated electronic circuitry as well as the interconnections between the remote data supply elements 2, 4, 6 and 8 and the communication processor 22 as well as the next data gathering panel 20. The removal of the cover 26 from the panel 14 is effective to interrupt the interconnections provided by the circuit board 26. Thus, the data distribution apparatus of the present invention provides a measure of security by signaling the removal of the cover 26 as a lack of data signals to the processor 22. The next data gathering panel 20 may have a structure similar to that shown for the illustrated data gathering panel 14 and may be connected via cable 30 to the communications processor 22.

Figure 2:
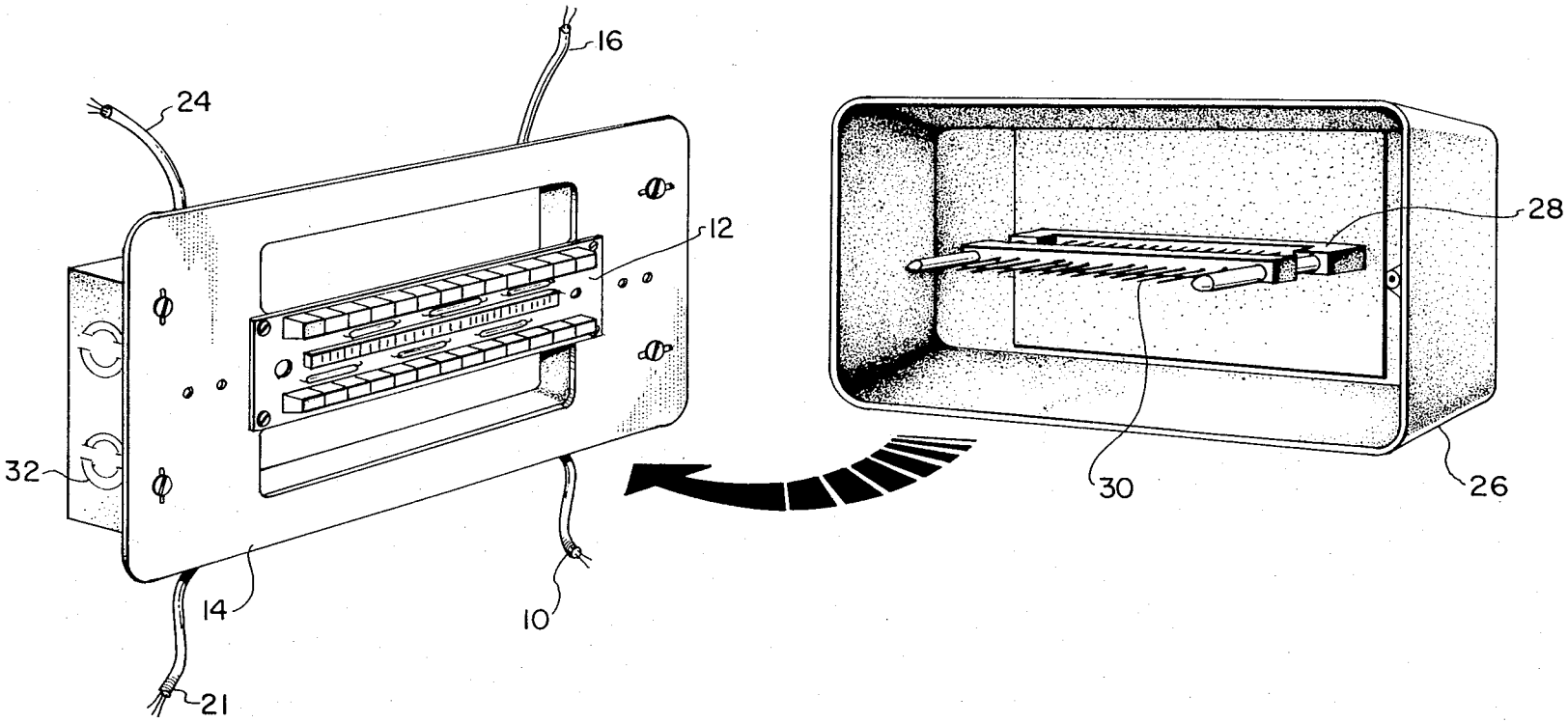

In FIG. 2, there is shown a pictorial illustration of the backplate 12 and the cover 26 used in the first data gathering panel 14. The cover 26 can be keyed by any suitable means to assure a correct orientation thereof with respect to the backplate connector 12. The panel 14 is mounted on a junction box 32 suitable for accommodating the wires 10 and 16 and the cables 21 and 24. Thus, the installation of the data handling system involved only the field wiring of the backplate 12 and the "start-up" of the system is achieved by plugging the cover 26 into the backplate 12.

Accordingly, it may be seen that there has been provided, in accordance with the present invention, an improved data distribution apparatus for a data handling system.

The embodiments of the invention in which an exclusive property or privilege is claimed are defined as follows:

1. A data distribution apparatus comprising:

connector means for providing a plurality of electrical connectors arranged in a fixed spatial orientation, electrical conductor means connected to said electrical connectors for providing a plurality of electrical conductors terminating at one end in corresponding ones of said electrical connectors, data supply means for supplying data signals connected to predetermined ones of said electrical conductors, data receiving means for receiving data signals connected to other ones of said electrical conductors than said predetermined ones, cover means for said connector means for electrically joining said electrical connectors in a predetermined pattern to establish electrical connections between said predetermined ones and said other ones of said electrical conductors when said cover means is mounted in a predetermined orientation on said connector means.

2. A data distribution apparatus as set forth in claim 1 wherein said data supply means includes remotely located electrical switches connected across respective pairs of said predetermined ones of said electrical conductors.

3. A data distribution apparatus as set forth in claim 1 wherein said data receiving means includes a data processor.

4. A data distribution apparatus as set forth in claim 1 wherein said data receiving means includes a second connector means for providing a plurality of electrical connectors arranged in a fixed spatial orientation and a second cover means for said second connector means for supplying electrical connections between ones of said electrical connectors in said second connector means.

5. A data distribution apparatus as set forth in claim 1 wherein said cover means includes a printed circuit board means having edge mounted electrical conductors for mating with respective ones of said electrical connectors.

6. A data distribution apparatus as set forth in claim 1 wherein said cover means includes keying means for assuring a mounting of said cover means on said connector means in said predetermined orientation.

7. An apparatus comprising:

connector means for providing a first plurality of electrical connectors for receiving electrical signals, and a second plurality of electrical connectors for supplying electrical signals and cover means for said connector means for electrically joining said first and second plurality of said electrical connectors in a predetermined pattern when said cover means is mounted on said connector means.

8. An apparatus as set forth in claim 7 wherein said cover means includes keying means for assuring said mounting of cover means on said connector means in a predetermined orientation.

9. An apparatus as set forth in claim 7 wherein said cover means includes a printed circuit board means having edge mounted electrical conductors for mating with respective ones of said electrical connectors and a printed circuit pattern connected to said edge mounted conductors for providing said electrically joining of said electrical connectors.

10. An apparatus as set forth in claim 7 wherein said connector means includes support means for supporting said electrical connectors in a fixed spatial orientation while allowing electrical connections thereto by electrical signal carrying conductors.

* * * * *